United States Patent [19]

Nakagawa et al.

[11] Patent Number: 5,013,220

[45] Date of Patent: May 7, 1991

[54] OIL PUMP HAVING REGULATOR VALVE ISOLATED FROM DYNAMIC PRESSURE OF PUMPED OIL

[75] Inventors: Takashi Nakagawa, Kariya City; Tetsuya Suyama, Nagoya, both of Japan

[73] Assignee: Aisin Seiki Kabushiki Kaisha, Kariya City, Japan

[21] Appl. No.: 444,428

[22] Filed: Dec. 1, 1989

[30] Foreign Application Priority Data

Feb. 22, 1989 [JP] Japan ..... 1-20054

[51] Int. Cl.[5] ..... F04B 49/08

[52] U.S. Cl. ..... 417/310

[58] Field of Search ..... 417/310

[56] References Cited

U.S. PATENT DOCUMENTS 3,146,720 9/1964 Henry ..... 417/310

FOREIGN PATENT DOCUMENTS 6081488 5/1985 Japan ..... 417/310

*Primary Examiner*—Leonard E. Smith
*Assistant Examiner*—Laleh Jalali
*Attorney, Agent, or Firm*—Oblon, Spivak, McClelland, Maier & Neustadt

[57] ABSTRACT

An oil pump comprising a housing, an inlet port formed in the housing, an outlet port formed in the housing, a pumping device located between the inlet port and the outlet port, a regulator valve device connected to the outlet port, and an interrupting device located between the pumping device and the regulator valve for substantially isolating the regulator valve from the dynamic pressure of the pumped oil.

6 Claims, 3 Drawing Sheets

OIL PUMP HAVING REGULATOR VALVE ISOLATED FROM DYNAMIC PRESSURE OF PUMPED OIL

BACKGROUND OF THE INVENTION

1. Field of the Invention

The present invention relates to an oil pump, and more particularly to oil pump for preventing misoperation of a regulator valve.

2. Background of the Related Art

A conventional oil pump 70 is disclosed in Japanese Utility Model Laid-open No. 62(1987)-67979, and is shown in FIG. 5. The oil pump 70 is used for an engine of a vehicle (not shown). In the oil pump 70, a pair of gears 71, 72 are located in a housing 79. An inlet port 74 is formed in the housing 79, and is connected to an inlet 73 which is formed in the housing 79. An outlet port 75 is formed in the housing 79, and the gears 71, 72 are located between the inlet port 74 and the outlet port 75. The outlet port 75 is connected to an outlet 78 and an inlet 76*a* of a regulator valve 76. An outlet 76*b* of the regulator valve 76 is connected to the inlet port 74 via a relief passage 77. A pair of shafts 80, 81 are snugly fitted with the gears 71, 72, and are supported by the housing 79.

In the above-mentioned oil pump 70, the oil which circulates in a hydraulic circuit (not shown) is led to the inlet port 74 via the inlet 73. The shaft 80 is driven by a crank shaft (not shown) of the engine, so that gears 71, 72 are rotated. Rotation of the gears 71, 72 perform a pumping function. Thus, the oil in the inlet port 74 is pumped to the outlet port 75.

The outlet 78 is located at right angles to the flow of oil discharged from the outlet port 75. Therefore, the oil discharged from the outlet port 75 flow directly into the inlet 76*a* of the regulator valve 76.

In general, the regulator valve 76 has as its function the keeping of the pressure of the oil pump 70 at a set value. But, the pumped oil flowing into the inlet 76*a* of the regulator valve 76 has both a dynamic pressure due to its flow velocity and a static pressure corresponding to the discharge pressure at the outlet 78. Therefore, the regulator valve 76 may operate to keep the discharge pressure at the outlet 78 at a low pressure because of the dynamic pressure effect on the regulator valve. This is a misoperation of the regulator valve of the oil pump.

SUMMARY OF THE INVENTION

Accordingly, it is a primary object of the present invention to prevent misoperation of a regulator valve of an oil pump due to the effect of the dynamic pressure on the regulator valve.

The above and other objects are achieved according to the present invention by an oil pump comprising a housing, an inlet port formed in the housing, an outlet port formed in the housing, a pumping device located between the inlet port and the outlet port, a regulator valve device fluidically communicating with the outlet port, and an interrupting device located between the pumping device and the regulator valve for substantially isolating the regulator valve from the dynamic pressure of the pumped oil.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
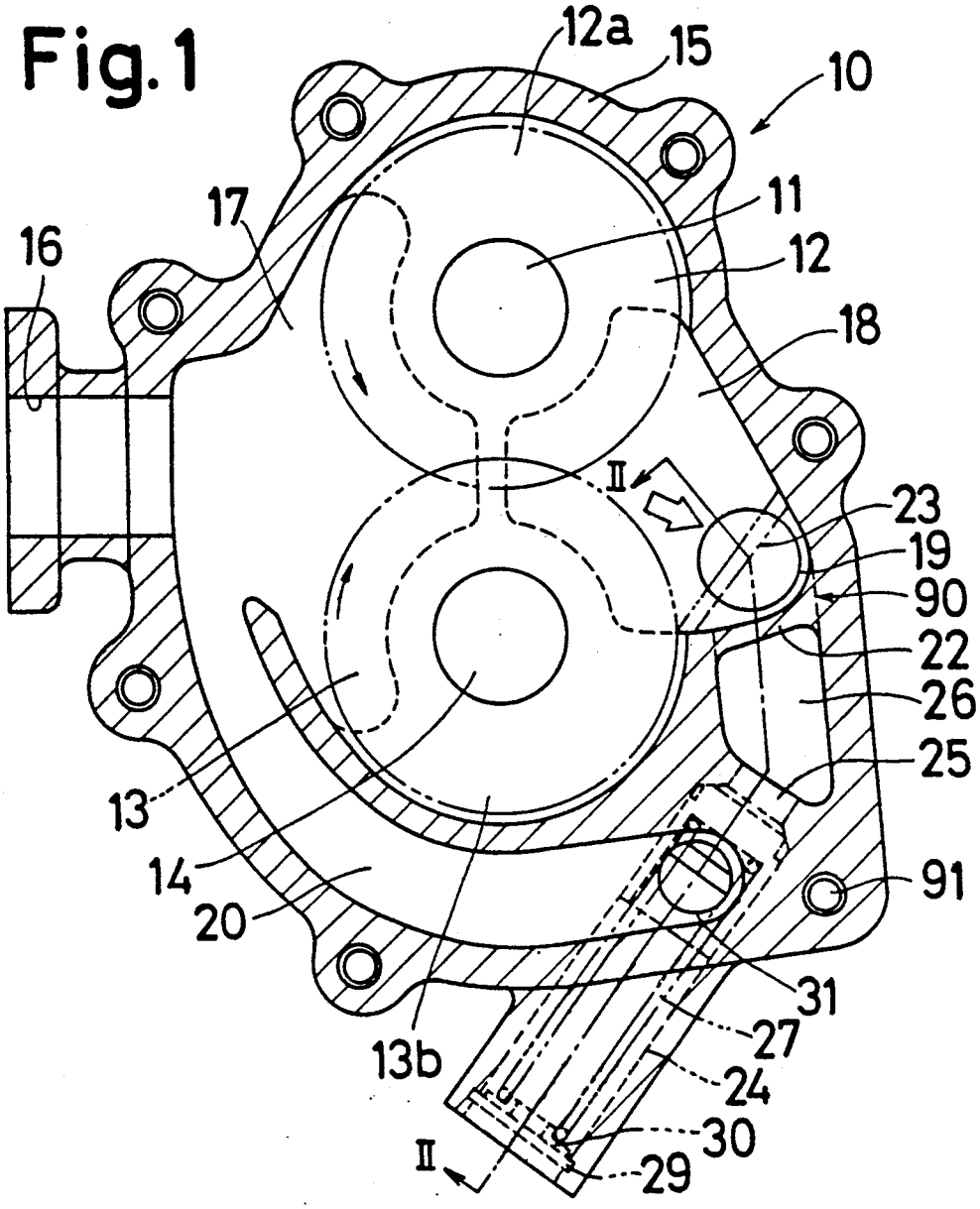
FIG. 1 is a perspective view of an oil pump to which the present invention is employed.
Figure 2:
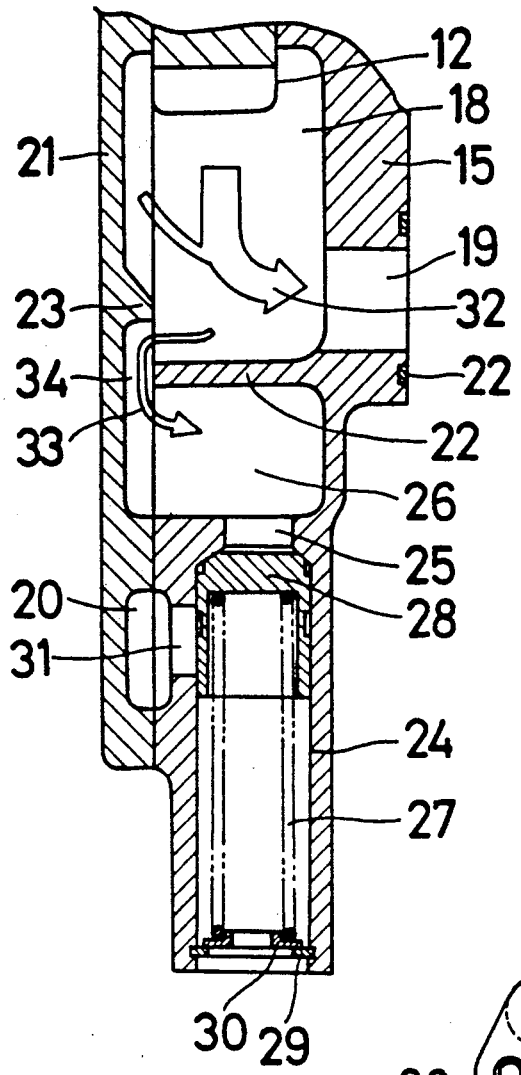
FIG. 2 is a cross-sectional view taken along line II—II in FIG. 1.
Figure 5:
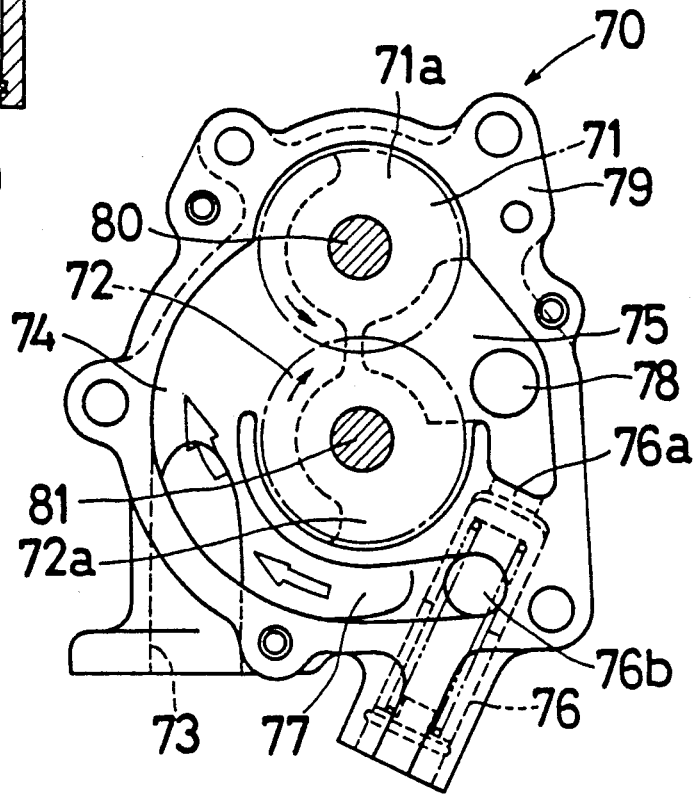
Fig. 5 PRIOR ART
FIG. 5 is a front view of a conventional oil pump.

Referring first to the embodiment of the present invention shown in FIGS. 1 and 2, wherein an oil pump 10 is shown, a pair of shaft 11, 14 are supported by a housing 5 having a cover 21, via bearings (not shown), and snugly fitted with a pair of gears 12, 13 in the housing. These gears 12, 13 are associated with shafts 11, 14 to form a pumping means. An inlet 16 is formed integrally with the housing 15, and connects to an inlet port 17 that is formed in the housing 15 on one side of gears 12, 13. An outlet port 18 is also formed in the housing 15 on the other side of gears 12, 13. An outlet 19 is formed integrally with the housing 15, and is located at right angles to the flow of the oil that is discharged from the outlet port 18. An inlet 25 of a regulator valve 24 is formed in the housing 15, and is also connected to the outlet 18 via a interrupting means 90. The interrupting means 90 comprises a chamber 26 at inlet 25 and partially isolated from the outlet port 18 by a rib member 23 and an interrupting member 22 comprised of a rib extending from the housing 15 substantially transverse to the flow direction of the oil being discharged from the gears 13, 13, and towards the cover 21 (FIG. 2) to form a passage 34. The rib member 23 is formed in the outlet port 18 and integrally with the cover 21. The interrupting member 22 is formed integrally with the housing. Thus the interrupting means 90 is provided between the pumping means and the regulator valve 24.

The cover 21 is connected to the housing 15 by plural bolts 91. The regulator valve 24 is constructed by a bore in the housing 15. An inlet to the bore forms the valve inlet 25. A plunger 28 is biased by a spring 27 mounted on a snap ring 29 and a retainer 30. A valve outlet is at 31. The spring 27 is interposed between the plunger 28 and the retainer 30, and creates a biasing force that is slightly higher than the setting discharging pressure of the oil pump 10. The snap ring 29 prevents the retainer 30 from coming out from the housing 15. The outlet 31 is connected to the inlet port 17 via a passage 20. Thus, a regulator valve means is provided by the regulator valve 24.

The operation of the oil pump 10 according to the first embodiment is described hereinafter.

Oil which circulates in a hydraulic circuit (not shown) is led to the inlet port 17 via the inlet 16. The shaft 11 is driven by a crank shaft (not shown) of an engine (not shown), so that the gears 12, 13 are rotated. Rotation of the gears 12, 13 performs a pumping function. Thus, the oil in the inlet port 17 is pumped to the outlet port 18.

This discharged oil has both a dynamic pressure and a static pressure at the outlet port 18. Thus, the discharging pressure of the oil pump 10 is composed of a dynamic pressure and a static pressure at the outlet port 18. However, the pressure applied to the inlet 25 of the regulator valve 24 has only the static discharging pressure component of the pumped oil from the outlet port 18. This is because the interrupting member 22 and the rib member 23 interrupt the flow 32 of the oil and change its direction so that the dynamic pressure is applied to the outlet 19. Consequently, the regulator valve is substantially isolated from the dynamic pressure of the pumped oil and acts only when the static discharging pressure at the outlet port 18 is higher than the set pressure. If such static pressure is applied to the inlet 25 via the passage 34 (see arrow 33), the plunger 28 moves downwardly against the spring 27. Thus, the inlet 25 is connected to the outlet 31 and the oil flows to inlet port 17 via the interrupting means 90, the regulator valve 24 and the passage 20. Therefore, the discharge pressure of the oil pump 10 is always kept at the desired pressure.

In the above first embodiment, there are many advantages. The dynamic pressure does not affect the regulator valve. Thus, the misoperation of the regulator valve is prevented. In addition, the interrupting means acts as a pressure pulse damper, due to the restricted passage 34, so that high frequency reciprocation and wear of the outer surface of the plunger which is caused in the prior art by rapid pressure changes is reduced. Accordingly, oil does not leak from between the inner surface of the regulator valve and the outer surface of the plunger. The load applied on the spring of the regulator valve is also reduced, so that malfunction of the spring is prevented.

Figure 4:
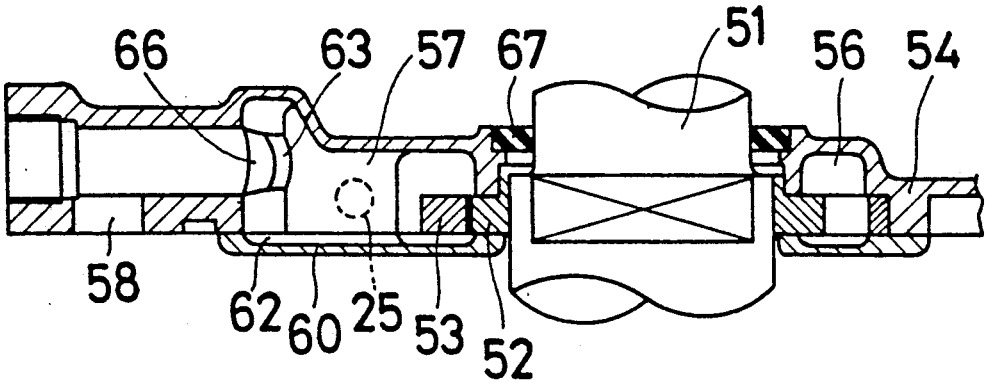
FIG. 4 is a cross-sectional view taken along line IV—IV in FIG. 3.

Next, referring to FIGS. 3 and 4 which shows an oil pump of a second embodiment according to the present invention, only the construction different from the first embodiment will be described hereinafter.

Figure 3:
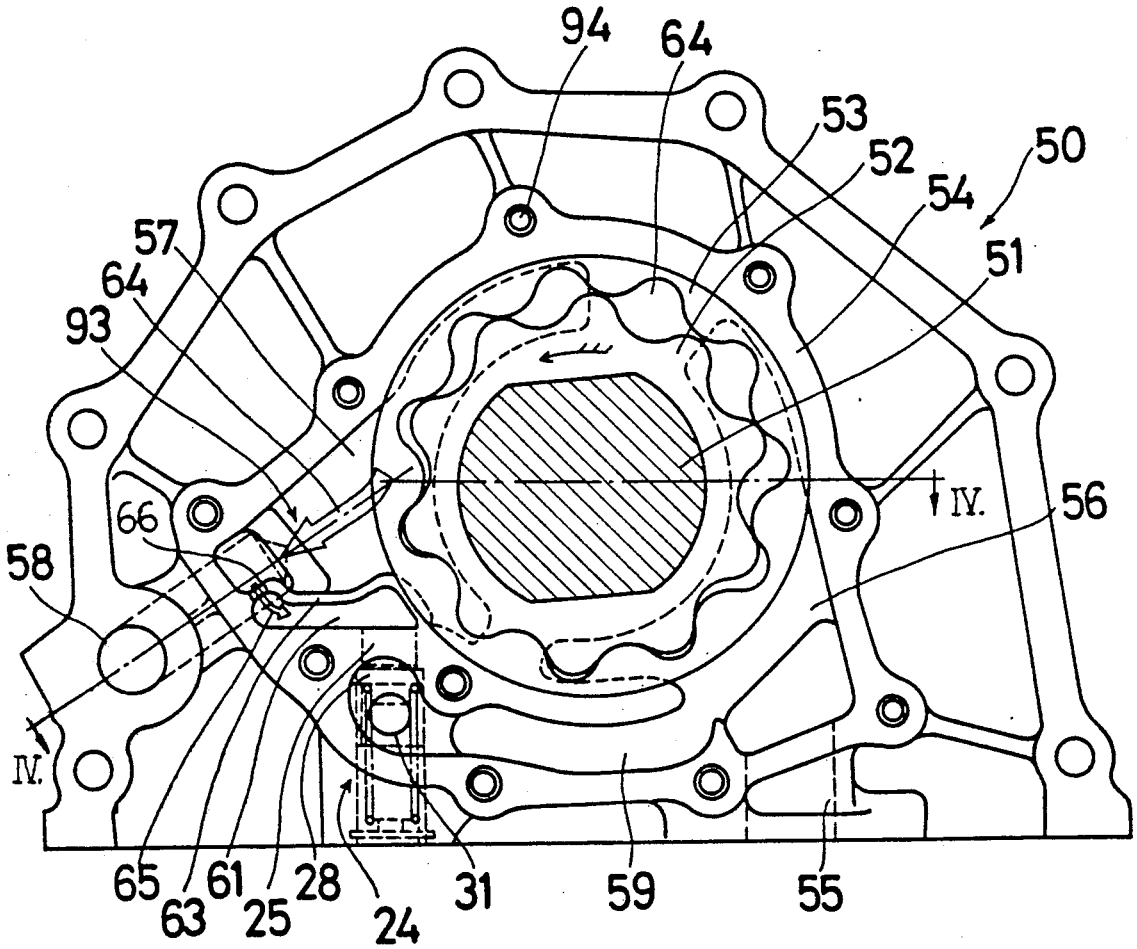
FIG. 3 is a view similar to FIG. 1, showing another embodiment to the invention.

A trochoid type oil pump 50 is shown in FIG. 3 and serves as a pumping means. A shaft 51 is snugly fitted with a drive-gear 52 that is engaged with a driven-gear 53. The shaft 51, the drive-gear 52 and the driven-gear 53 are rotatably accommodated in a housing 54 via a seal 67. An inlet 55 is formed integrally with the housing 54, and connects to an inlet port 56 that is formed in the housing 54. An outlet port 57 is formed in the housing 54. An outlet 58 is formed integrally with the housing 54, and is located at right angles to the flow of oil that is discharged from the outlet port 58.

The inlet 25 of the regulator valve 24 is installed within the housing 54, and is also connected to the outlet port 57 via an interrupting portion 93. The interrupting portion 93 is constructed with a passage 61 which is isolated from the outlet port 57 by a partition wall formed by a rib member 62 formed on a cover 60 and rib member 63 formed on the housing 54. A through hole 66 is drilled through the rib member 63 to provide a flow passage of oil from the outlet port 57 to the passage 61. The cover 60 is connected to the housing 54 by plural bolts 94. The outlet 31 of the regulator valve 24 is connected to the inlet port 56 via a passage 59.

The operation of the oil pump 50 according to the second embodiment is generally the same as that described with reference to FIG. 1, so that only the differences in operation will be described.

The oil discharged from the outlet port 57 flows out to the outlet 58, and also flows into the through hole 66. The direction of flow of the oil discharged from the outlet port 57 is illustrated by arrow 64, and the direction of flow of the oil flowing into the through hole 66 is illustrated by arrow 65 and is at right angles to the flowing direction 64. Therefore, the discharging oil with its dynamic pressure does not flow into the regulator valve via the through hole 66 and the passage 61.

The advantages according to the second embodiment are the same as those according to the first embodiment.

Obviously, numerous modifications and variations of the present invention are possible in light of the above teachings. It is therefore to be understood that within the scope of the appended claims, the invention may be practiced otherwise than as specifically described herein without departing from the intent and teachings of the invention.

What is claimed is:

1. An oil pump comprising:

a housing;

an inlet port formed in the housing;

an outlet port formed in the housing;

pumping means located between the inlet port and the outlet port for pumping oil from said inlet port to said outlet port;

a regulator valve fluidically communicating with said outlet port; and an interrupting means located between said pumping means and said regulator valve for substantially isolating said regulator valve from a dynamic pressure of pumped oil, whereby low oil pressure is avoided;

said interrupting means comprising a rib portion provided on said housing and forming a restricted passage leading to said regulator valve;

a cover cooperating with said housing to define said outlet port, further including a rib portion on said cover cooperating with said rib portion on said housing for forming said passage.

2. An oil pump as set forth in claim 1, wherein the pumping means is a gear pump.

3. An oil pump as set forth in claim 1, wherein the pumping means is a trochoid-type pump.

4. An oil pump as set forth in claim 1, wherein said regulator valve comprises:

a bore in said housing and having a valve inlet and valve outlet;

a plunger in said bore; and a spring pressing said plunger to close said valve inlet.

5. An oil pump as set forth in claim 4, including a passage that connects said valve outlet to said inlet port.

6. An oil pump comprising:

a housing;

an inlet port formed in the housing;

an outlet port formed in the housing;

pumping means located between the inlet port and the outlet port for pumping oil from said inlet port to said outlet port;

a regulator valve fluidically communicating with said outlet port; and an interrupting means located between said pumping means and said regulator valve for substantially isolating said regulator valve from a dynamic pressure of pumped oil, whereby low oil pressure is avoided;

said interrupting means comprising a rib portion provided on said housing and forming a restricted passage leading to said regulator valve;

said rib portion on said housing forming a partition wall wherein said passage is a hole in said rib portion;

said oil pump including a cover cooperating with said housing to define said outlet port, further including a rib portion on said cover cooperating wtih said rib portion on said housing for forming said partition wall.

* * * * *